United States Patent [19]

Unterhoffer et al.

[11] 4,446,655

[45] May 8, 1984

[54] WEATHERPROOF DOUBLE DOOR STRUCTURE, AND AN ENCLOSURE EMBODYING SUCH STRUCTURE

[75] Inventors: Peter P. Unterhoffer, Nepean; Gilles L. Dufresne, Alymer, both of Canada

[73] Assignee: Northern Telecom Limited, Montreal, Canada

[21] Appl. No.: 325,304

[22] Filed: Nov. 27, 1981

[51] Int. Cl.[3] ..... E06B 7/16

[52] U.S. Cl. ..... 49/368; 49/395; 312/229; 312/283

[58] Field of Search ..... 49/368, 367, 395, 485; 312/283, 257 SK, 229

[56] References Cited

U.S. PATENT DOCUMENTS

| | | | |
|---|---|---|---|
| 879,200 | 2/1908 | Schrader | 49/367 |
| 2,582,540 | 1/1952 | Gruse | 49/367 |
| 3,103,996 | 9/1963 | Wyatt, Jr. | 49/367 |
| 4,186,056 | 1/1980 | Muller et al. | 49/485 X |
| 4,265,051 | 5/1981 | Williams | 49/367 |

*Primary Examiner*—Philip C. Kannan

*Attorney, Agent, or Firm*—Sidney T. Jelly

[57] ABSTRACT

A weatherproof structure for a double-door closing of an unobstructed door opening has an uninterrupted, continuous, gutter along the top of the door opening. The continuous channel or gutter has an open side facing outwards with the open side having a low wall. A channel at the inner edge of a first door has an open side facing outward, the channel extending inward from the outer surface of the door, the door also having an inturned upper edge. A second door has an inturned upper edge and inner edge, the inturned inner edge entering the channel at the inner edge of the first door. A recess extends into the channel at the inner edge of the first door, from an inner surface, the recess admitting the low wall of the continuous gutter or channel. A slot in the inturned inner edge of the second door fits over the recess in the channel at the inner edge of the first door. Gaskets can be provided to enhance sealing. The structure can be repeated for the bottom of the door opening. For an enclosure, the double door structure can be on one side or both sides. Latches provide a closing force to enhance sealing.

20 Claims, 15 Drawing Figures

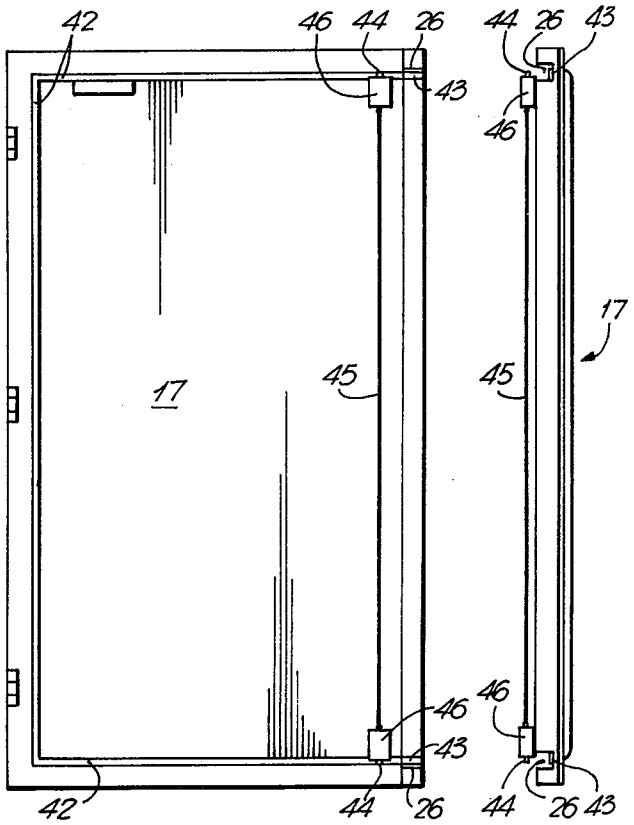
FIG.4.
FIG.3.
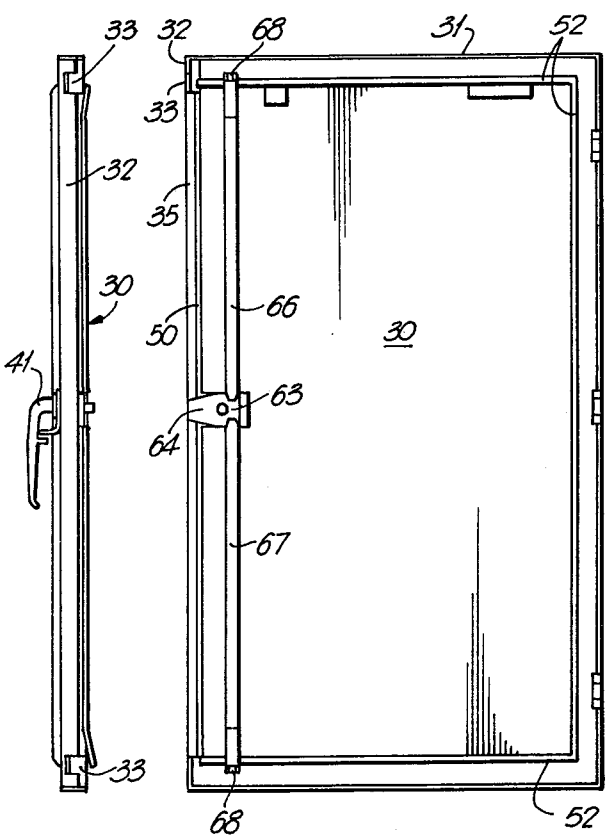
FIG.5.
FIG.6.

WEATHERPROOF DOUBLE DOOR STRUCTURE, AND AN ENCLOSURE EMBODYING SUCH STRUCTURE

This invention relates to a weatherproof double door structure, and an enclosure embodying such a structure. Particularly the invention is applicable to housings and enclosures containing equipment such as telecommunications equipment and similar electrical equipment.

Outdoor enclosures, particularly for electrical and electronic equipment, need to be sealed against the environment, when closed. Also, the enclosure should be resistant to vandalism. With large enclosures having double doors and no central vertical bar, providing a complete seal all round the periphery of the doors is extremely difficult, particularly preventing ingress of water. Gutters can be formed along the top of the enclosure, with cooperating formations on the tops of the doors. Any water entering between the top of a door and the top of the enclosure is caused to fall into the gutter. However, the overlapping of the doors to prevent ingress of water between the doors, prevents the formation of a continuous gutter along the top of the enclosure, and along the bottom. Normally the gutter is cut, leaving a gap into which the door edge formations fit, and some attempt is made to prevent water leaking through the gap between the gutter end and door edges. This is usually not fully effective.

The present invention provides an arrangement which gives overlapping interengaging formations at the mating edges of the doors and also a continuous gutter along the top edge, and also the bottom edge if desired. There is provided a continuous channel at mating edges of the doors and along the top, and bottom, so that water entering between the edges of the doors and between the tops of the doors and the enclosure, can drain away along the channels. Similarly a channel along the bottom drains away water entering between the bottoms of the doors and the enclosure. Channels also extend down the sides of the enclosure for drainage of water entering between the hinged edges of the doors and the enclosure and also to provide a drainage path for water in the top channel. Gaskets are provided for sealing inward of the channels. In enclosures having access to back and front, with double doors, the drainage is provided back and front, and also the gasket sealing.

A double door structure comprises a continuous channel along the top of door opening of an enclosure, the channel having an open side facing towards the outside of the enclosure, the open side having a low wall extending the length of the channel; a channel at the inner edge of a first door, the channel having an open side facing outward, the channel extending inward from the doors outer surface, the door also having an inturned upper edge; a second door having an inturned inner edge and inturned upper edge, the inturned inner edge entering the inner edge channel of the first door; a U-shaped recess extending into the inner edge channel of the first door, from an inner surface, the recess admitting the low wall of the continuous channel along the top of the door opening on closing of the first door; and a U-shaped slot in the inturned inner edge of the second door, the slot fitting over the U-shaped recess in the inner edge channel of the first door, on closing of the second door.

The channel formed along the top of the door opening can extend all round the door opening, with similar interengaging recess and slot at the bottoms of the inner edges of the doors. Gaskets can provide a positive seal between the low wall of the channel around the door opening and the doors, and further gaskets provided at the interengaging recesses and slots to provide positive sealing at these positions. A gasket in the bottom of the channel at the inner edge of the first door provides positive sealing with the inturned inner edge of the second door.

There is thus provided a controlled leakage or drainage path for water all round the doors, backed up by a positive seal. The channel formations and inturned edges provide very effective resistance to vandalism.

The invention will be readily understood by the following description of a particular embodiment, by way of example, in conjunction with the accompanying drawings, in which:

FIG. 3 is a view on the inside of a first door;

FIG. 4 is a view on the inner edge of the first door as in FIG. 3;

FIG. 5 is a view of the inside of a second door;

FIG. 6 is a view on the inner edge of the second door as in FIG. 5;

Figure 1:
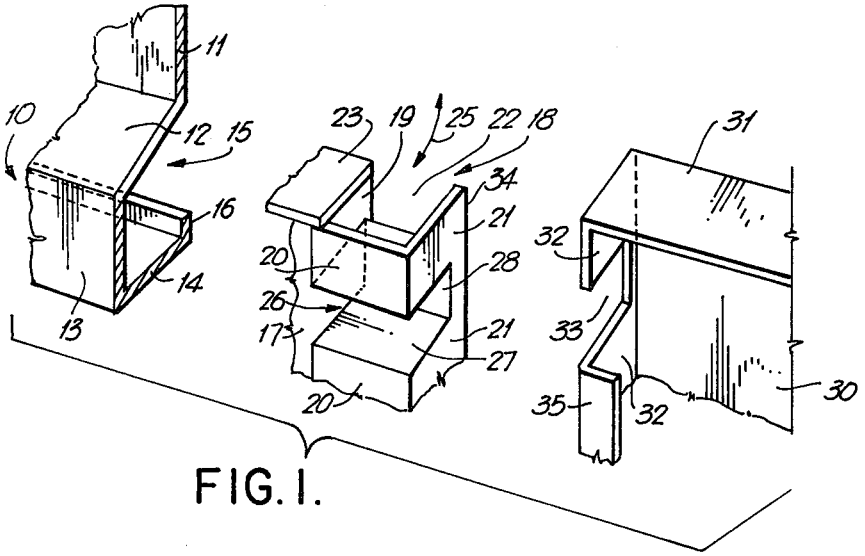
FIG. 1 illustrates diagramatically the interengaging top channel, first door channel and recess and second door inner edge and slot.
Figure 7:
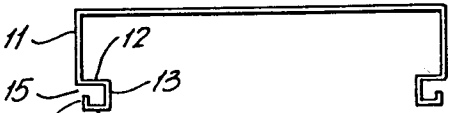
FIG. 7 is a cross-section through a top panel of an enclosure, illustrating the gutter formation.

FIG. 1 illustrates, in a very general and diagrammatic manner, the basic features of the invention. The area illustrated is the top center of a housing with the top inner corners of the doors and the channel at the top of the door opening. The area illustrated is as seen from the inside. In the Figure, at the left is the channel at the top of the door opening, indicated generally at 10. Surface 11 is the outer surface which surrounds the door opening, the channel formed by the walls 12, 13 and 14. The open side, at 15, has a low front wall 16. The cross-section of the channel is also seen in FIG. 7.

The top inner edge of a first door 17 is indicated generally at 18, having a U-shaped channel defined by walls 19, 20 and 21. The channel extends inward from the outer surface of the door 17 and has an open side 22 facing outwards. The door also has an inturned top edge 23. The door pivots on hinges at the side remote from that shown, as indicated by the arrows 25. To enable the door to close with the upper part of wall 20 adjacent to the rear wall 13 of the top channel 10, a recess 26 is formed in the channel at the inner edge of the door 17, the recess being U-shaped, re-entrant into the door edge channel. The recess 26 is positioned a distance down from the top of the door, that the bottom wall 27 of the recess passes under the bottom wall 14 of the top channel, the top part of wall 20 entering through the open side 15 of the channel. The low front wall 16 abuts the rear wall 28 of the recess, which, as explained in more detail later, has gasket material thereon, but not indicated in FIG. 1.

By this structure, the first door can be closed and still permits of an unbroken top channel. The second door, 30, has an inturned top edge 31 and an inturned inner edge 32. At a distance down from the top edge 31, generally equal to the positioning of the recess 26 in the door 17, a slot 33 is formed in the inturned inner edge 32. The slot is of such dimensions that it passes over the recess 26 in door 17. The edge 34 of the wall 21 of the first door 17 abuts the inner surface of the second door 30, on which there a gasket can be placed, not indicated in FIG. 1. The inner edge 32 of door 30 can also be turned in, at 35 and arranged to abut wall 20 of door 17. Again a gasket can be positioned on the inner surface of wall 20.

Thus FIG. 1 illustrates the general principle of the invention, whereby it is possible to provide a continuous channel, or gutter, 10 and at the same time have two doors close, without cutting the channel. The doors are closed sequentially and complete closure is obtained against water without a central post. Water entering between the top of either door and the enclosure framing the door will finish up in the channel. At the closure position between the two doors, the water will run down to the top of recess 26 forward and down the rear wall 28 of the recess, and then straight down the channel at the inner edge of the first door 17 to the bottom. A similar structure can be provided at the bottom, the arrangement inverted with a channel along the bottom of the door opening.

Figure 15:
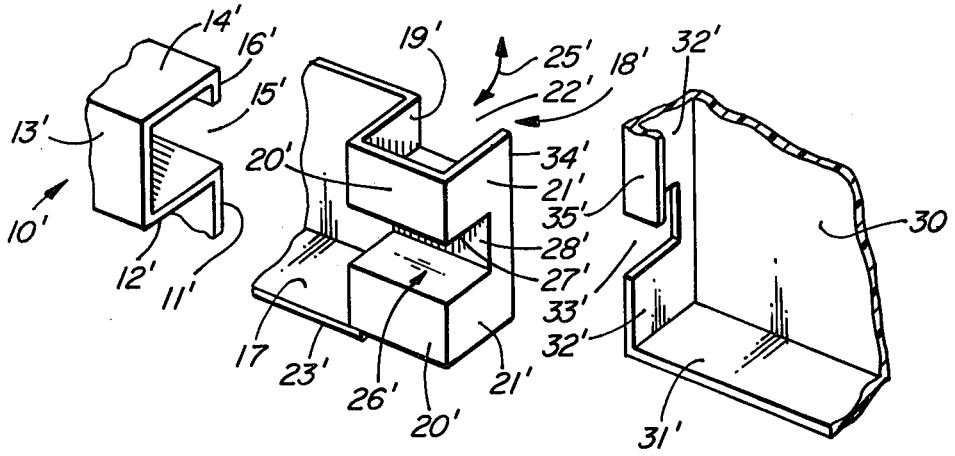
FIG. 15 illustrates diagrammatically the structure for the bottom of a door enclosure, being an inverted arrangement of the structure illustrated in FIG. 1.

This structure is illustrated in FIG. 15, where the same reference numerals are used for corresponding details, but with a prime. Thus, as seen in FIG. 15, at the left is the channel at the bottom of the door opening, indicated generally at 10'. Surface 11' is the outer surface which surrounds the door opening, the channel formed by the walls 12', 13', and 14'. The open side, at 15', has a low front wall 16'.

The bottom inner edge of the first door 17 is indicated generally at 18', having a U-shaped channel defined by walls 19', 20' and 21'. The channel extends inward from the outer surface of the door 17 and has an open side 22' facing outwards. The door also has an inturned lower edge 23'. The door pivots on hinges at the side remote from that shown, as indicated by the arrows 25'. To enable the door to close with the lower part of wall 20' adjacent to the rear wall 13' of the channel 10', a recess 26' is formed in the channel at the inner edge of the door 17, the recess being U-shaped, re-entrant into the door edge channel. The recess 26' is positioned a distance up from the bottom of the door, that the top wall 27' of the recess passes over the top wall 14' of the channel, the lower part of wall 20' entering through the open side 15' of the channel 10'. The low front wall 16' abuts the rear wall 28' of the recess, which, as explained in more detail later, has gasket material thereon, but not indicated in FIG. 15.

By this structure, the first door can be closed and still permits of an unbroken bottom channel. The second door, 30, has an inturned lower edge 31' and an inturned inner edge 32'. At a distance up from the lower edge 31', generally equal to the positioning of the recess 26' in the door 17, a slot 33' is formed in the inturned inner edge 32'. The slot is of such dimensions that it passes over the recess 26' in door 17. The edge 34' of the wall 21' of the first door 17 abuts the inner surface of the second door 30, on which there a gasket can be placed, not indicated in FIG. 15. The inner edge 32' of door 30 can also be turned in, at 35' and arranged to abut wall 20' of door 17. Again a gasket can be positioned on the inner surface of wall 20'.

The water running down the inner edge channel will drain into this channel, as will water entering between the bottom edge of either door and the bottom enclosure framing.

Figure 2:
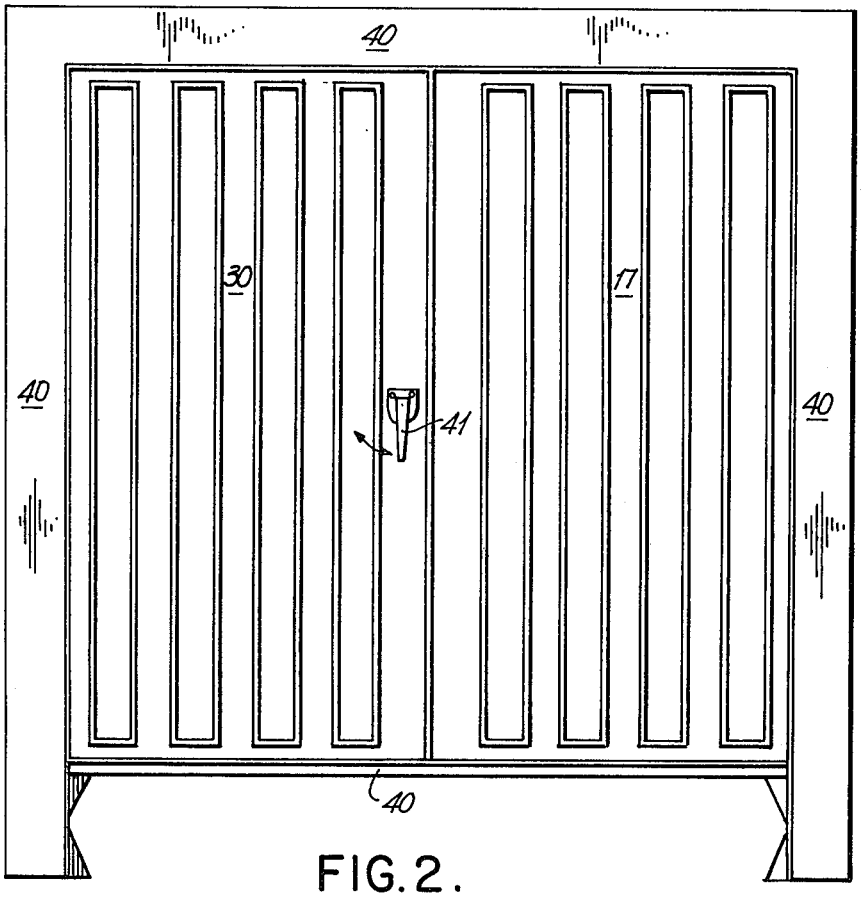
FIG. 2 is a view on the front of an enclosure.

FIG. 2 is a front view of an enclosure 40, with two doors, corresponding to doors 17 and 30 of FIG. 1. In many cases access to the rear is also required and in such cases two doors are also provided at the rear. The rear view would then be the same as the front view of FIG. 2. A latching handle 41 is provided which actuates latches at top and bottom, and also in the middle, to exert a positive pressure against a seal. The latches are described later with respect to FIGS. 13 and 14.

Figure 9:
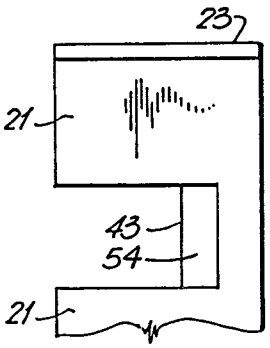
FIG. 9 is a view in the direction of arrow A in FIG. 8.
Figure 8:
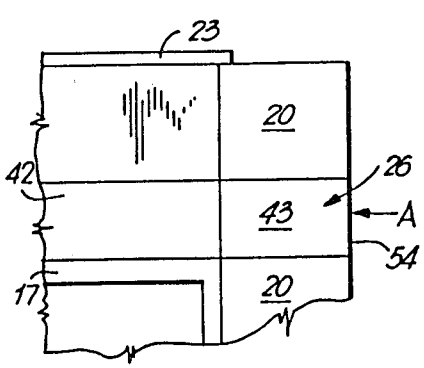
FIG. 8 is an inside view of the top inner corner of the first door, showing gaskets.

FIGS. 3 and 4 illustrate the inner surface or side of the first door 17 and an end view on the inner edge of the first door 17 respectively. Recesses 26 are shown, at top and bottom and also shown is a gasket 42 which extends along near the top and bottom of the door and near the hinge edge of the door. The gasket provides a seal against the low wall 16 of channels at top and bottom of the enclosure. A similar channel is provided down each side of the enclosure, both front and back if doors are in front and back, and the side section of gasket 42 seals against a similar low wall on the channel at the side. A typical gasket material is a neoprene rubber. An inturned edge can be provided at the hinged edge of the door, the inturned edge entering the channel down the side of the enclosure or door opening. A short length of gasket is applied to the rear wall 28 of the recess 26, at 43. A typical thickness for the gasket 43 on wall 28 is 0.25" while the typical thickness for gasket 42 is 0.5". This is to provide a common level surface of gasket 42 and gasket sections 43. This is illustrated in more detail in FIGS. 8 and 9. Top and bottom latches 44, recessing in guides 46, are shown in FIGS. 3 and 4. The latches 44 are connected by, in the example, a nylon rope 45, and are biased to a latched position by compression springs in the guides 46. The ends of the latches 44 engage behind the wall 13 of the channel at top and bottom and can have inclined ends to give a wedging action to force the door edges against the gaskets. Once door 30 is open, door 17 can be opened by pulling on the rope 45.

Figure 11:
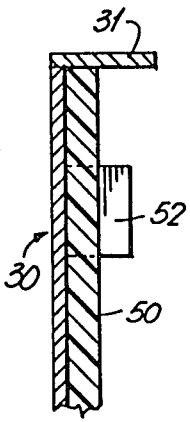
FIG. 11 is a cross-section on the line XI-XI of FIG. 10.
Figure 10:
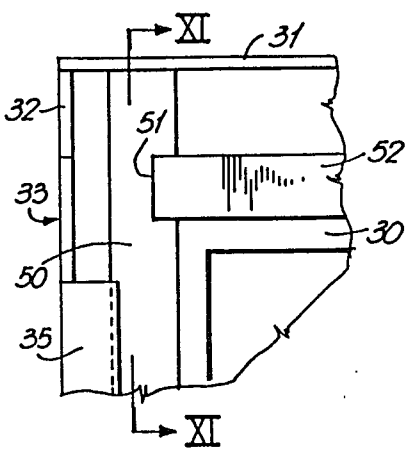
FIG. 10 is an inside view of the top inner corner of the second door, showing the gaskets.

FIGS. 5 and 6 are similar views of the second door 30, as FIGS. 3 and 4 of door 17. The slots 33 are seen in FIG. 6. A sealing gasket extends round near the periphery of the door, comprised of two sections. A first section 50 extends up near the inner edge of the door, positioned for contact with the edge of the wall 21 of the channel formed at the inner edge of door 17, this edge of the wall identified at 34 in FIG. 1. A second section 52 extends along the top, down the hinge side and along the bottom. In the example illustrated, the thickness of section 50 is 0.25" and the thickness of section 52 is 0.5". The end surface 51 of sections 52 abuts against the end surface 54 of gasket 43. Section 52 is contacted by the low wall 16 of the channel which extends along the top of the door opening and also down the sides and along the bottom. The two sections 50 and 52, at the top inner corner of the door, are illustrated in FIGS. 10 and 11. Again a typical material is neoprene rubber. As with door 17, an inturned edge can be provided at the hinged edge of the door, the inturned edge entering the channel down the side of the enclosure or door opening.

Figure 12:
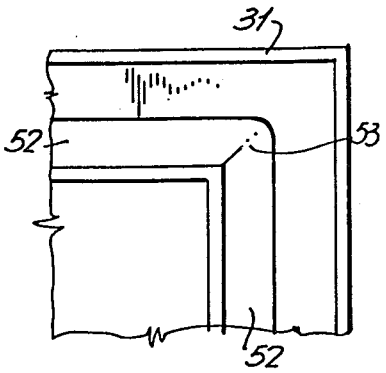
FIG. 12 is a view of the top outer corner of a door showing the gasket arrangement.

FIG. 12 is an illustration of a corner of a gasket, for example the top corner at the hinge side. The gasket material, normally in strip form, is notched and bent round to form a corner 53. A similar arrangement is used at other corners, such as with gasket 42, in FIG. 3.

Conveniently, the enclosure 40 has a channel formation all round the door opening. When access is required at both back and front, a door opening is provided in back and front, two doors in each opening. Both sets of doors, and the surrounding opening are of the same form of structure, as illustrated in FIG. 1 particularly. FIG. 7 illustrates channels at both front and back.

The overlapping structure, between the doors and the enclosure at top, bottom and hinged sides of the doors, and the overlapping structure at the mating door edges, in addition to providing a closely controlled path for water, also is very effective against vandalism. It is extremely difficult to get any form of bar or tool between door and frame, or between mating edges of doors, due to the channel at the edge of the door opening, and to the channel on one door edge. In addition, should the inner walls be forced in, these will tend to interlock, thus hindering entry.

Figure 14:
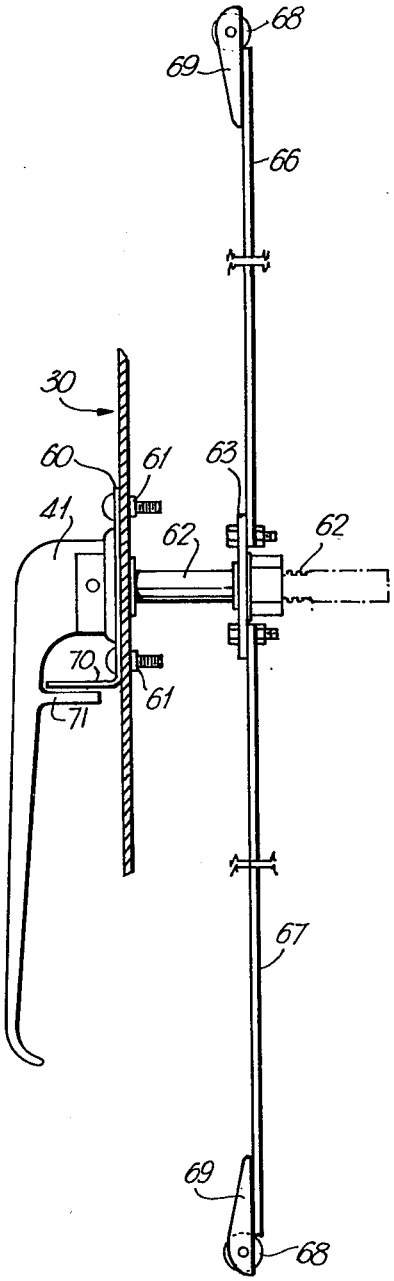
FIGS. 13 and 14 are enlarged front and side recesses of the latch, as illustrated in FIGS. 5 and 6 in greater detail.
Figure 13:
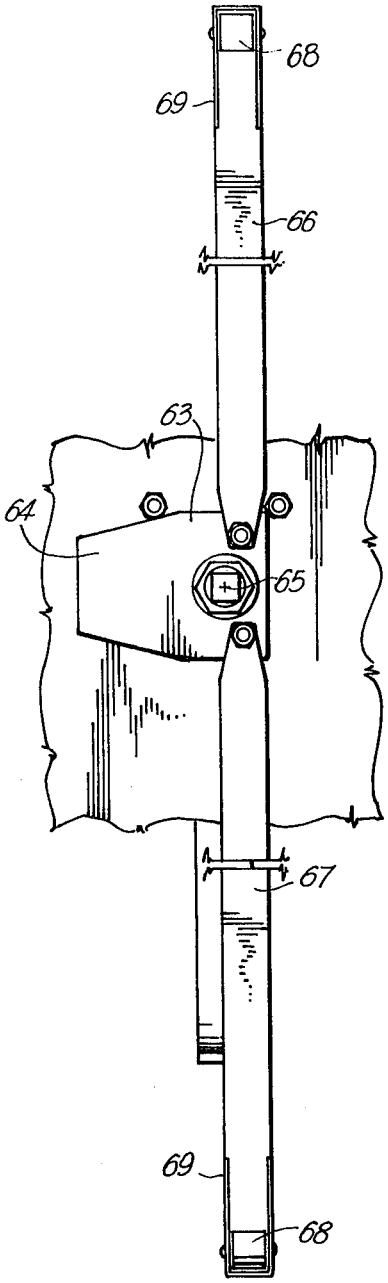

FIGS. 13 and 14 illustrate in more detail the latches and associated handle on door 30. The handle 41 is pivotally mounted on the front of the door 30, by means of a plate 60 attached by screws 61. A shaft 62 extends inward from the handle 41 and carries a flat plate-like lever 63 which has a tongue portion 64 extending towards the door edge 32 when the handle is in a latching position, that is with the handle extending downward as in FIGS. 2 and 14. The pivotal axis of handle 41 and lever 63 is indicated at 65 in FIG. 13. To the top and bottom of the lever 63, on the side of axis 65 remote from the tongue 64, two rods 66 and 67 are pivotally attached. Rod 66 extends upward and rod 67 downward.

At the ends of rods 66 and 67 remote from the lever 63 are attached rollers 68, the rollers carried in brackets 69 formed on or attached to the ends of the rods. The assembly of lever 63 rods 66, 67 and rollers 68 is also illustrated in FIG. 5. The rollers 68 are arranged to be in engagement with the inner surface of the wall 13 of the channel surrounding the door opening. The rods 66 and 67 are biased so as to produce a closing force on the door 30, and thus also on door 17 as the handle 41 is turned to a latched position, the rollers rolling up onto the wall 13. This closing force forces the various door edges into firm contact with the gaskets 42, 43, 50, 52. The rods 66 and 67 can run in guides attached to the inner surface of the door 30. The tongue 64 engages behind the wall 20 of the door 17.

A bracket 70 can be formed on the plate 60, extending outward and a lug 71 can extend inward from the handle 41. Holes in the bracket 70 and lug 71 provide for insertion of a padlock to lock the handle 41 in a latched position.

What is claimed is:

1. A weatherproof sealing structure for a double door opening, said opening being unobstructed in an open condition and having first and second doors hingedly mounted at outer edges in a frame defining the sides of said door opening, said doors having contiguous inner edges when in a closed condition, said sealing structure comprising:

a continuous channel along the top of said door opening, the channel having an open side facing toward an outer surface and including a wall extending part way up said open side;

a channel at the inner edge of said first door and having an open side facing towards an outer surface of the door, the channel extending inwards from said outer surface, and an inturned upper edge on said first door;

an inturned inner edge and an inturned upper edge on said second door, said inturned inner edge entering said channel at the inner edge of said first door, in a closed condition;

a recess extending into said channel at said inner edge of said first door, the recess extending from an inner surface of said channel and positioned to admit the low wall of said continuous channel, said inturned upper edge of said first door entering said continuous channel, in a closed condition;

a slot in the inturned inner edge of said second door, said slot fitting over said recess in said channel of said inner edge of said first door and said inturned upper edge of said second door entering said continuous channel on closing of said second door on to said first door.

2. A structure as claimed in claim 1, including a gasket positioned to seal between said wall extending part way up said open side of said continuous channel and an inner surface on each of said doors.

3. A structure as claimed in claim 1, including a gasket positioned to seal between said wall extending part way up said open side of said continuous channel and a cooperative surface in said recess extending into the channel at the inner edge of the first door.

4. A structure as claimed in claim 1, including a gasket positioned to seal between said slot in the inturned inner edge of the second door, and a cooperative outer surface on said recess extending into the channel at the inner edge of the first door.

5. A structure as claimed in claim 1, said continuous channel extending down the sides of said door opening.

6. A structure as claimed in claim 2, including an inturned edge at the outer edge of each door, and entering into said continuous channel down the sides of said door opening, when said doors are in a closed condition.

7. A structure as claimed in claim 5, including a gasket positioned to seal between the wall extending part way up the open side of said continuous channel extending down the sides of the door opening and an inner surface of each door.

8. A structure as claimed in claim 1, including a further continuous channel extending along the bottom of said door opening, the further channel having an open side facing toward an outer surface and including a wall extending part way down said open side;

an inturned lower edge on each of said first and second doors;

a further recess extending into said channel at said iner edge of said first door, the recess extending from an inner surface of the channel and positioned to admit the lower wall of said further continuous channel, said inturned lower edge of said first door entering said further continuous channel, in a closed condition;

a further slot in the inturned inner edge of said second door, said slot fitting over said further recess, in said channel at said inner edge of said first door and said inturned lower edge of said second door entering said further continuous channel on closing of said second door on to said first door.

9. A structure as claimed in claim 8, including a gasket positioned to seal between said wall extending part way down said open side of said further continuous channel and an inner surface on each door.

10. An enclosure of rectangular plan form, and having front, back and two sides, including an unobstructed opening in said front, said opening constituting a door opening, said door opening being closed by two doors hingedly mounted at outer edges in said door opening, said doors having contiguous inner edges, said door opening and doors including a weatherproof sealing structure as claimed in claim 4.

11. A structure as claimed in claim 8, including a gasket positioned to seal between said wall extending part way down said open side of said further continuous channel and a cooperative surface in said further recess extending into the channel at the inner edge of the first door.

12. A structure as claimed in claim 8, including a gasket positioned to seal between said further slot in the inturned inner edge of the second door and a cooperative outer surface on said recess extending into the channel at the inner edge of the first door.

13. A structure as claimed in claim 12, including a gasket positioned to seal between the inner edge of said first door and an inner surface of said second door.

14. An enclosure of rectangular plan form, and having front, back and two sides, including an unobstructed opening in said front, said opening constituting a door opening, said door opening being closed by two doors hingedly mounted at outer edges in said door opening, said doors having contiguous inner edges, said door opening and doors including a weatherproof sealing structure as claimed in claim 1.

15. An enclosure as claimed in claim 14, including a further unobstructed opening in said back, said further opening constituting a further door opening, said further door opening being closed by two further doors hingedly mounted at outer edges in said further door opening, said further doors having contiguous inner edges, said further door opening and said further doors including a weatherproof sealing structure as claimed in claim 1.

16. An enclosure as claimed in claim 15, including a further unobstructed opening in said back, said further opening constituting a further door opening, said further door opening being closed by two further doors hingedly mounted at outer edges in said further door opening, said further doors having contiguous inner edges, said further door opening and said further doors including a weatherproof sealing structure as claimed in claim 4.

17. A structure as claimed in claim 1, including latching means on each door, the latching means on said first door including a spring loaded latch on an inside surface at the top and bottom of the first door adjacent to the inner edge thereof, said latches engaged over upper and lower edges of the door opening in a latched position, and means for moving said latches against the spring loading to disengage from the upper and lower edges of the door.

18. A structure as claimed in claim 17, said spring loaded latches having inclined ends, said inclined ends cooperating with said upper and lower edges of said door opening to give a wedging action urging said doors to a tightly closed condition.

19. A structure as claimed in claim 17, the latching means on the second door comprising:

a handle pivotally mounted on an outside surface of the door;

a shaft connected to the handle and extending through said door and rotatable about the pivotal axis of said handle;

a lever member carried on said shaft and rotatable therewith about said axis, said lever including a tongue portion extending from said axis towards the inner edge of the door and engaged behind the inner edge of said first door when in a latched position;

a first actuating member extending upward from said lever member;

a second actuating member extending downward from said lever member;

said first and second actuating members pivotally attached at inner ends to said lever member on the side of said pivot axis remote from said tongue portion;

a latch member attached to each actuating member at an outer end, said latch members engaged over and behind upper and lower edges of said door opening in a latched position;

pivoting of said handle to an unlatched position moving said tongue portion and said latch members within the inner edge and top and bottom edges of the door.

20. A structure as claimed in claim 19, said actuating members comprising rods, and each latch member comprising a roller at the outer end of a rod, said rollers biased to urge said second door into a tight sealing engagement with said top and bottom edges of said door opening and with the inner edge of said first door.

* * * * *